United States Patent [19]

Bauer et al.

[11] Patent Number: 4,979,718

[45] Date of Patent: Dec. 25, 1990

[54] LOCKABLE ELEVATING MECHANISM FOR THE CONTINUOUS ADJUSTMENT OF SEATS, TABLE TOPS OR SIMILAR ITEMS OF FURNITURE

[75] Inventors: Hans J. Bauer; Hans-Peter Bauer, both of Altdorf, Fed. Rep. of Germany

[73] Assignee: Suspa Compart Aktiengesellschaft, Altdorf, Fed. Rep. of Germany

[21] Appl. No.: 756,844

[22] Filed: Jul. 19, 1985

Related U.S. Application Data

[63] Continuation-in-part of Ser. No. 631,776, Jul. 17, 1984, abandoned.

[30] Foreign Application Priority Data

Jul. 29, 1983 [DE] Fed. Rep. of Germany ..... 3327425
Apr. 12, 1984 [DE] Fed. Rep. of Germany ..... 3413804
Jul. 27, 1984 [DE] Fed. Rep. of Germany ..... 8422413

[51] Int. Cl.[5] ..... A47C 3/00

[52] U.S. Cl. ..... 248/631; 297/347; 108/147; 411/417; 188/322.18

[58] Field of Search ..... 248/631, 622, 161, 354.1; 297/345, 347; 108/147; 411/417, 418, 353, 517; 188/196 R, 322.18, 322.17

[56] References Cited

U.S. PATENT DOCUMENTS

| | | | |
|---|---|---|---|
| 1,083,697 | 1/1914 | Neptune | 411/517 |
| 2,444,380 | 6/1948 | Shimek | 411/517 |
| 2,712,262 | 7/1955 | Knohl | 411/521 |
| 3,007,726 | 11/1961 | Parkin . | |
| 3,320,846 | 5/1967 | Orain | 411/521 |
| 3,359,021 | 12/1967 | Wurzel | 411/517 |
| 3,656,593 | 4/1972 | Bauer | 248/354.1 |
| 3,711,054 | 1/1973 | Bauer . | |
| 3,788,587 | 1/1974 | Stemmler | 248/631 |
| 3,790,119 | 2/1974 | Bauer | 248/631 |
| 3,963,101 | 6/1976 | Stadelmann | 248/354.1 |
| 4,113,220 | 9/1978 | Godwin | 248/631 |
| 4,163,617 | 8/1979 | Nemoto | 403/132 |
| 4,283,033 | 8/1981 | Bauer | 248/188 |
| 4,422,611 | 12/1983 | Kitsuda | 248/421 |
| 4,478,531 | 10/1984 | Levinson | 403/133 |
| 4,543,988 | 10/1985 | Huveteau | 411/521 |

FOREIGN PATENT DOCUMENTS

| | | | |
|---|---|---|---|
| 642264 | 1/1964 | Belgium | 188/322.17 |
| 1550162 | 8/1979 | United Kingdom | 248/161 |
| 2095364 | 9/1982 | United Kingdom | 297/345 |

*Primary Examiner*—Ramon O. Ramirez
*Assistant Examiner*—Robert A. Olson
*Attorney, Agent, or Firm*—Browdy and Neimark

[57] ABSTRACT

In a lockable elevating mechanism for the continuous adjustment of chair seats, table tops or the like, a guide sleeve (1), attachable to a pedestal (4), and a length-adjustable lockable gas spring (8) are proposed, the piston rod (10) of which is connected axially fixed but detachable with the bottom of the guide sleeve (1). The housing (9) of the gas spring (8) can be connected axially fixed, but basically detachable, with a chair seat or the like by means of an upper fastening segment (21) seated in corresponding collar (22). An activating rod (26) extends upwardly from the housing (9). In order to easily detach the gas spring (8) from the chair seat or the table top, the housing (9) of the gas spring (8) is disposed radially fixed in an additional tube (20) having the fastening segment (21), wherein one end of the housing (9) axially rests against a stop in the area of the fastening segment (21) and wherein the other end rests against a fastening element (24), detachably connected with the tube (20).

12 Claims, 2 Drawing Sheets

LOCKABLE ELEVATING MECHANISM FOR THE CONTINUOUS ADJUSTMENT OF SEATS, TABLE TOPS OR SIMILAR ITEMS OF FURNITURE

This is a continuation-in-part of application Ser. No. 631,776 filed July 17, 1984.

FIELD OF THE INVENTION

The invention relates to a lockable elevating mechanism having a gas spring supported within a housing radially fixed within an additional tube, the tube defining at one end a stop against which the housing abuts and supporting a fastener bearing against the other end of the housing to hold the latter in abutment with the stop.

BACKGROUND OF THE INVENTION

In an elevating mechanism of this kind, known from U.S. Pat. No. 3,711,054, the generally cylindrical other surface of the gas spring housing is guided directly in a guide sleeve connected with the guide tube. Not only is the gas spring supporting and length-adjustable, but it also is a guiding and pivotable element. Because the piston rod is fastened in the base plate of the guide tube not just freely pivotable, but also radially with sufficient free play, the gas spring can adjust to possible changes in the direction of stress of the seat or the table top without danger of jamming. Furthermore, the seals around the piston rod of the gas spring are not unilaterally stressed, so that the gas spring will not become leaky and therefore inoperational. Thus the gas spring is cushioned on its sides with respect to the tube-like column, so that jamming neither occurs between piston rod and cylinder nor between cylinder and the tube-like column.

Lockable elevating mechanisms of this kind have proven themselves in actual operation for a long time and to a large degree.

The attachment of the gas spring housing on the underside of the seat or table top is accompanied by means of a clamping device comprising a cylindrical upper section of the gas spring housing, such as is known from U.S. Pat. No. 3,711,054 or 4,283,033, for instance. It is furthermore known to equip the gas spring with a conical attachment section for the purpose of providing a connection between the gas spring housing and the underside of the chair seat or the table top, which is inserted by force into a corresponding collar on the underside of the chair seat or the table top. The advantage of this embodiment is to make a connection between the chair seat or table top and the elevating mechanism very easy, which is of special advantage in the case of the shipment of such furniture while disassembled and the subsequent reassembly by the seller or buyer. Such a conical embodiment of the attachment is known from the U.S. Pat. No. 3,790,119. However there is the danger in such conical plug connections that the attachment section and the corresponding collar will seize because of the constant loads and therefore will no longer be separated, especially not without the use of tools, by which the upper surface of the gas spring housing, which is movable in respect to the guide tube, can be damaged.

SUMMARY OF THE INVENTION

One object of the present invention therefore is to provide an elevating mechanism of this kind, while retaining all advantageous characteristics with little cost, in which the gas spring can be disengaged from the chair seat or the table top in a simple manner.

This object is accomplished by incorporating an additional tube in the gas spring housing, which can be connected in a simple manner with the chair seat or the table top by means of a particularly conical attachment section and a corresponding attachment element, for instance a conical collar. For the purpose of maintenance, where the gas spring has to be disengaged from the base plate of the guide tube, the gas spring itself only requires a simple cylindrical housing with an untreated outer surface, and may be extracted from the additional tube after a single fastening element on its underside has been loosened. Since the housing and tube are radially connected with one another, both the housing and tube together contribute to the lateral strength, i.e. the deformation strength, of the entire elevating mechanism. This is further accomplished in an especially simple manner by disposing the gas spring housing in the tube with a close sliding fit thereby assuring that the elevating mechanism is very slim. These features of the invention increase, to a considerable degree, the safety of the entire mechanism.

Moreover, by this invention, not only can pressure points between the gas spring housing and the additional tube be avoided, but it is also possible to retain a slide for the activation of an activating rod. Finally, this invention permits the releasable connection between the additional tube and the gas spring to be simply realized by making the fastening element as an elastic locking ring.

The fastening element can exhibit sprung projections lying against the inner wall of the tube. It can in particular be connected to the gas spring in such a manner that it cannot turn whereby the sprung projections engage in at least one groove with lead in the inner wall of the tube. In order to achieve ease of detachment of the gas spring and the tube whilst maintaining simple assembly and tight fit, the gas spring exhibits a shoulder protruding from the tube which is provided with surfaces for a spanner.

However, a lockable elevating mechanism for the continuous adjustment of chair seats or the like, known from German Design Patent No. 19 61 656, includes two tubes moving telescopically relative to each other. One of the tubes is a lower guide tube which is connected to a base, while the other is an upper tube which moves inside the guide tube and is permanently connected with a base plate fastened to the underside of the seat. A longitudinally adjustable gas spring is disposed in this telescoping column, the upper end of which is fastened by screws to the aforementioned plate, and the piston rod of which is fastened with screws to a base plate of the guide tube. This embodiment had been further developed into the elevating mechanism of this species in accordance with U.S. Pat. No. 3,711,054. In this embodiment there is also no attachment of a section of the gas spring itself to the chair seat or the like in the manner of the invention.

Further advantages and characteristics of the invention can be seen from the description of an exemplary embodiment based on the drawings.

DESCRIPTION OF THE PREFERRED EMBODIMENTS

Figure 1:
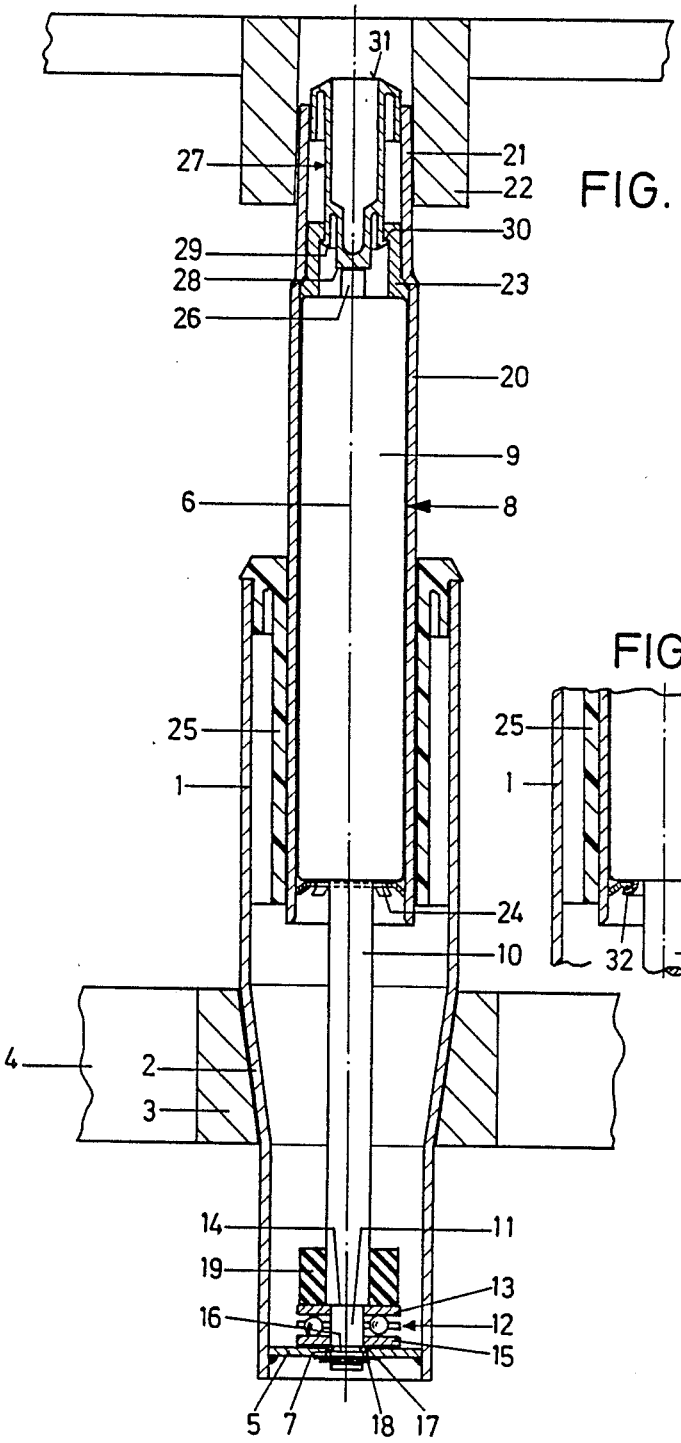
FIG. 1 shows an elevating mechanism in accordance with the invention partially in longitudinal section.

The lockable elevating mechanism for the continuous adjustment of seats or table tops, shown in the drawings, has a lower guide sleeve 1, generally designed in cylindrical form, which has in its lower part a section 2, conically tapered downwardly, which contains a corresponding collar 3 of a pedestal 4. The guide sleeve 1 has an end plate 5 near its lower end showing an opening 7 which is concentric to the central longitudinal axis 6 of the entire elevating mechanism and therefore also to the guide sleeve 1. Disposed parallel to the longitudinal axis 6 is a length-adjustable, hydraulically or pneumatically lockable gas spring 8. The cylindrical housing 9 of the spring is located in the upper area of, and extends upwardly through, the guide sleeve 1. The piston rod 10 of the spring extends downwardly through the housing 9 and is removably connected with the end plate 5. For this purpose, the free end of the piston rod 10 is designed with a tang 11, which has a reduced diameter, on which is disposed an axial ball bearing 12, the upper race 13 of which is supported against the collar 14 formed in the transition area between the tang 11 and the piston rod 10, while the lower race 15 is supported against the end plate 5. In addition, a securing collar 16, mounted on the tang, holds the axial ball bearing 12 in the position shown, even if the lower race 15 is not supported against the end plate 5.

The tang 11 is placed into the opening 7 with sufficient play of from some tenth of a millimeter to a millimeter, so that the piston rod 10 is not radially braced with respect to the guide sleeve 1. From the outside, i.e. at the bottom, a spacer 17, having a diameter larger than that of the opening 7, is placed on the tang 11. A securing element 18 is pushed against the spacer 17 so that the piston rod 10 of the gas spring 8 is firmly connected to the guide sleeve 1 axially, but removably. On the piston rod 10 there is an end positioning, or impact, damper 19 made from rubber, which rests with its underside against the upper race 13 of the axial ball bearing 12.

The continuously circular cylindrical housing 9 of the gas spring 8 is disposed with sliding fit in a tube 20, which is also circular cylindrical in its essential length. The radial play between the housing 9 and the tube 20 is some one hundredth to maximally one or two-tenth of a millimeter. The play is therefore just sufficient to insert the housing 9 of the gas spring 8 into the tube 20 or to pull it out therefrom and, at the same time, to guide the housing 9 in the tube 20 radially and to hold it. This tube 20, forming a removable part of the gas spring 8, is provided in its upper part, which extends above the housing 9, with a conically tapered fastening segment 21, which forms a solid, simply made plug connection with a corresponding collar 22 fastened to the underside of a chair, armchair, table top of the like. At the transition to the fastening segment 21, a casing 23, designed in accordance with the tapering of the tube 20, is disposed in the latter and is therefore fixed axially in the direction towards the fastening segment 21. The housing 9 of the gas spring 8 is axially firmly supported against this casing 23.

At the lower free end of the tube 20, the housing 9 is axially held by means of a removable fastening element 24. This can be in the form of a so-called claw, i.e. a ring provided with resilient tabs, which can be pushed into the tube 20 in one direction, namely until it rests against the housing 9, with relative ease, but which resists movement in the opposite direction by barb-like bracing against the tube. With sufficient force, for instance by the use of a screw driver, it can be easily taken out in a downwardly direction, thus breaking the connection between the housing 9 and the tube 20 in a simple manner. Naturally, many other kinds of fastening elements, including screw connections, can be considered.

This tube 20, forms a removable part of the gas spring 8 and is axially movable in the usual manner in the guide sleeve 1. The guide sleeve is provided in its upper area with a guiding sleeve 25 of a suitable plastic. The guide sleeve 1, however, and the tube 20 are made of steel. The same is the case for the housing 9 of the gas spring 8, while the casing 23 consists of a softer material, for instance die cast zinc.

Longitudinal adjustment of the gas spring 8 and corresponding height adjustment of the entire elevating mechanism is achieved with the help of an activating rod 26 of the gas spring 8, which extends from the upper end of gas spring 8 away from the piston rod 10, and which is pushed into the housing 9 in order to make possible the respective adjustment in length. For this purpose, an upward extending slide 27 is disposed in the conically tapering fastening segment 21 and rests against the activating rod 26 with a face 28. Furthermore, this slide 27 is supplied with securing prongs 29, which elastically grip the back or underside of a corresponding ring 30 of the casing 23, and permit the slide 27 to be secured against inadvertent falling out of, or removal from, the fastening segment 21 while, at the same time, assuring the seating with little play of the face 28 against the activating rod 26. Activation is accomplished by means of a swivelable activating lever, not shown, which is disposed in the collar 22 in the usual manner and which rests against the outer surface 31 of the slide 27, as is known, for instance, from U.S. Pat. No. 3,790,119.

In order to replace the gas spring 8, only the lower securing element 18 needs to be loosened. Then the chair seat, the table top or the like, together with the tube 20 and the gas spring 8 can be pulled out of the guide sleeve 1. After loosening the fastening element 24 as described, the actual gas spring 8 can be pulled from the tube 20. The connection between the tube 20 and the collar 22, i.e. the fastening element attached to the chair or the table top, does not have to be undone. The casing 23 will most likely have been so deformed by the stress that it will be seated with sufficient tightness in the tube 20 and therefore will not slip out during disassembly and subsequent reassembly. In order to insert the activating rod 26 into the housing 9, the securing prongs 29 of the slide 27 slide freely along the inside of casing 23.

Figure 2:
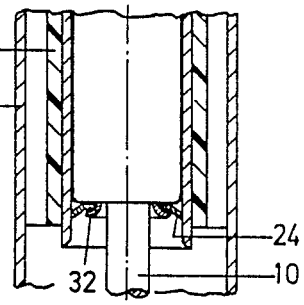
FIG. 2 shows a partial view of a changed embodiment.

In the embodiment in accordance with FIG. 2, an annular collar 32 is disposed on the end of the gas spring where the piston rod exits, preferably on the guide and sealing plug normally present there, over which annular collar the fastening element 24, designated as an elastic locking ring, is pushed. Afterwards, annular collar 32 is crimped to the outside so that the fastening element 24 is axially and unmovably connected with the gas spring 8. Assembly of the gas spring 8 in the tube 20 is made easier because, after the gas spring 8 has been inserted into the tube 20, it is only necessary to tap the tang 11 of the piston rod 10 with a soft hammer, such as a rubber mallet or the like, in order to force the cylindrical housing 9 of the gas spring 8 completely into the tube 20 and to bring the fastening element 24 into the locking position shown in the drawing.

In the alternative, the fastening element 24 can also be open at one end and can be pushed obliquely under the annular collar 32. Such an embodiment would ease removal of the fastening element 24 after the removal of the gas spring 8 from the tube 20.

Obviously the tube 20 can also have a non-circular cross-section, and could be designed for example, as a polygon. In such a case it should have at least a triangular cross-section and useful embodiments should have hexagonal or octagonal cross-sections. In such a case, the guiding sleeve 25 would need to have a corresponding cross-section. If in such a case the tube 20, together with the gas spring 8 was made non-turning with respect to the guide sleeve 1, then the axial ball bearing 12 could naturally be omitted.

Figure 3:
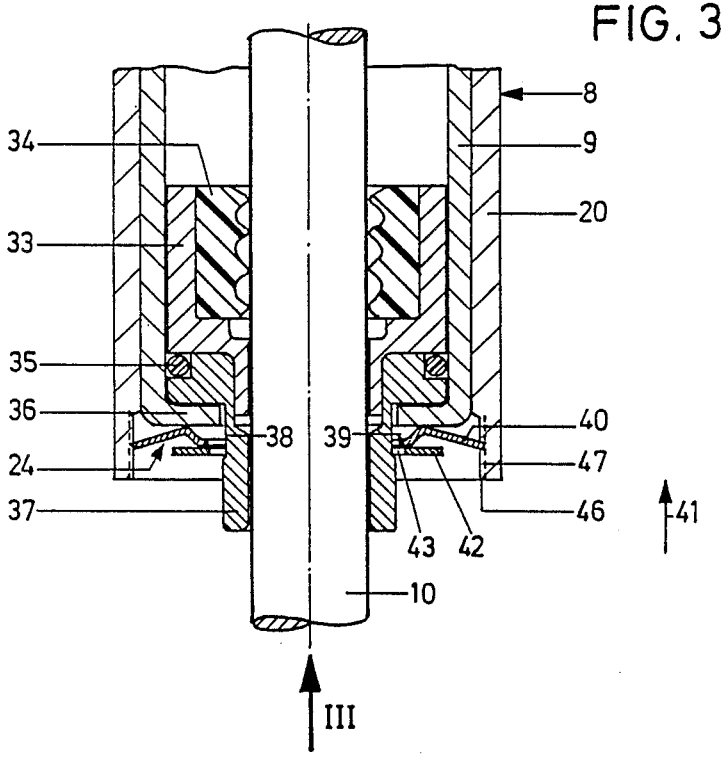
FIG. 3 shows a partial view of another changed embodiment.
Figure 4:
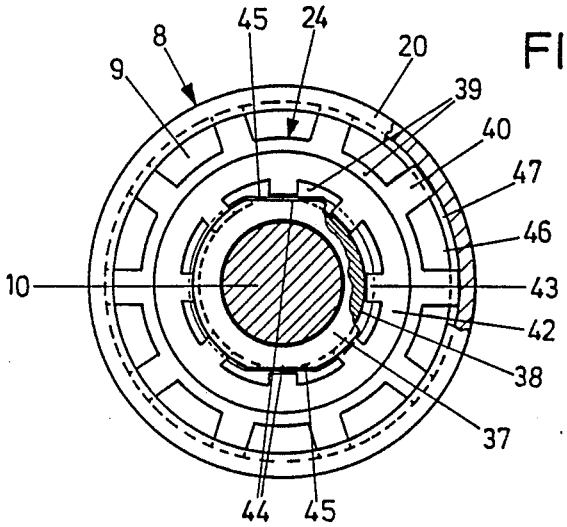
FIG. 4 shows a view of the embodiment according to arrow III in FIG. 3.

In the FIGS. 3 and 4 a further embodiment is illustrated whereby FIG. 3 shows some details of the gas spring 8 employed. Just as in the case of the embodiments according to FIGS. 1 and 2, this embodiment is in principle designed as illustrated and described in German Patent No. 18 12 282 (corresponding to U.S. Pat. No. 3,656,593). On the end where the piston rod 10 emerges it exhibits a sealing and guide bush 33 which can be in one piece or—in the case in question—in two pieces. A multiple lip seal 34 resting against the piston rod 10 is located in this bush 33, said multiple lip seal resting against the piston rod 10. Moreover, a seal 35 is positioned in it, said seal resting against the cylindrical housing 9 of the gas spring 8 so that a gas-tight seal is provided at this point. The cylindrical housing 9 of the gas spring 8 exhibits an edge 36 beaded around this bush 33. The bush 33 exhibits a sleeve-like sections 37, which surrounds the piston rod 10 and protrudes outwards from the housing 9. This sleeve-like section 37 also exhibits an undercut adjacent to the edge 36. A so-called claw, which is formed by a ring 39 with sprung projections 40 protruding outwards, is arranged as a fastening element 24 in the area of this undercut. This fastening element 24 consists of spring steel. The projections 40 are inclined outwards against the direction of insertion 41 so that they can grip in the inner wall of the tube 20 like barbs against the direction of insertion 41.

The ring 39 is held axially on the sleeve-like section 37 by a securing collar in the form of a pronged ring 42 whose sprung prongs 43 protruding inwards radially are held and secured in the undercut 38. Thus, the fastening element 24 can be mounted and axially held by simply pushing it and subsequently the pronged ring 42 onto the sleeve-like section 37.

The sleeve-like section exhibits—as is illustrated in FIG. 4—two diametrically opposite even surfaces 44 which run parallel to each other up to the edge 36 and whose distance apart corresponds to the standard space for an open-jawed spanner. The ring 39 of the fastening element 24 is provided with two appertaining faces 45 so that the fastening element 24 is mounted on the sleeve-like section 37 in such a manner that it cannot be turned. The sealing and guide bush 33 with the section 37 is naturally mounted in the gas spring so that it cannot turn.

A groove 47 with lead running round the inner wall of the tube 20 several times (i.e. a thread-like cut) is provided in the area of the tube's insertion opening 46. When the gas spring 8 is pressed into the tube 20, the sprung projections 40 of the fastening element 24 can each give owing to their afore-mentioned inclination until they engage in the area of the groove, said area corresponding to the final axial position of the gas spring 8 in the tube 20. A solely axial disengagement of the fastening element 24 and thus a withdrawal of the gas spring 8 from the tube 20 is therefore almost impossible. However, owing to the engagement of the sprung projections 40 in the groove 47 the gas spring 8 can be unscrewed out of the tube 20 by turning it relative to the tube 20 with a spanner which grips the surfaces 44 of the sleeve-like section 37 immediately outside the tube 20.

Therefore very simple assembly by axial pressing-in and at the same time dismantling by unscrewing are possible. The sprung bracing of the projections 40 in the groove 47 acts as an additional axial safeguard.

The gas spring 8 used for the elevating mechanism is known from U.S. Pat. No. 3,656,593 reference is made to.

It is to be understood that the foregoing text and drawing relate to an embodiment of the invention given by way of example but not limitation. Various other embodiments and variants are possible within the spirit and scope of the invention.

What is claimed is:

1. A lockable elevating mechanism for the continuous adjustment of chair seats, table tops or similar pieces of furniture having a guide sleeve attachable to a pedestal and a length-adjustable gas spring, the latter including a piston rod fixed axially, yet detachably, to an end plate of the guide sleeve, a housing axially detachably fixed by means of an upper fastening segment with a corresponding collar on the furniture, the housing being disposed in the guide sleeve laterally fixed and axially slidable, and from the housing of which an activating rod for the longitudinal adjustment of the gas spring upwardly extends into the fastening segment, comprising:

the housing of the gas spring being fixed radially in an additional tube having a fastening segment for fastening the elevating mechanism to the corresponding collar of the furniture, one end of the housing resting axially against a stop in the area of the fastening segment, said stop comprising a casing of a softer material than at least on of the tube or the housing, and the other end of said housing resting against a detachable fastening element detachably connected with the tube so that said housing is locked in said tube between said stop and said fastening element; and a slide resting against said activating rod and connected with the casing, said slide being disposed in and extending from the fastening segment.

2. A lockable elevating mechanism in accordance with claim 1, wherein said fastening element is provided with screw connections.

3. A lockable elevating mechanism in accordance with claim 1, wherein said detachable element is formed by an elastic locking ring.

4. A lockable elevating mechanism in accordance with claim 1, wherein said detachable fastening element is connected axially non-movably with the gas spring.

5. A lockable elevating mechanism in accordance with claim 1, wherein the housing of the gas spring is disposed in the tube with a close-sliding fit.

6. A lockable elevating mechanism in accordance with claim 5, wherein said detachable fastening element is formed by an elastic locking ring.

7. A lockable elevating mechanism in accordance with claim 6, wherein said detachable fastening element is connected axially non-movably with the gas spring.

8. A lockable elevating mechanism in accordance with claim 1, wherein the detachable fastening element exhibits sprung projecting lying against the inner wall of the tube.

9. A lockable elevating mechanism in accordance with claim 1, wherein the detachable fastening element is connected to the gas spring in such a manner that it cannot turn and that the sprung projections engage in at least one groove with lead in form of a thread in the inner wall of the tube.

10. A lockable elevating mechanism in accordance with claim 9, wherein the gas spring exhibits a sleeve-like section protruding from the tube for retaining the fastening element in a torsionally fixed manner.

11. A lockable elevating mechanism in accordance with claim 1, wherein the gas spring is provided with surfaces for a spanner.

12. A lockable elevating mechanism in accordance with claim 10, wherein said sleeve-like section is provided with contact faces for a spanner.

* * * * *